US008477060B2

(12) United States Patent
Belz et al.

(10) Patent No.: US 8,477,060 B2
(45) Date of Patent: Jul. 2, 2013

(54) PROGRAMMING A REMOTE CONTROL USING REMOVABLE STORAGE

(75) Inventors: Steven M. Belz, Cedar Park, TX (US); James Pratt, Round Rock, TX (US); Paul Van Vleck, Austin, TX (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 648 days.

(21) Appl. No.: 12/618,350

(22) Filed: Nov. 13, 2009

(65) Prior Publication Data

US 2011/0115664 A1 May 19, 2011

(51) Int. Cl.
*G08C 19/16* (2006.01)

(52) U.S. Cl.
USPC ..... 341/176; 340/12.23

(58) Field of Classification Search
USPC ..... 341/176; 340/12.22, 12.23, 12.25, 340/12.26, 12.28
See application file for complete search history.

(56) References Cited

U.S. PATENT DOCUMENTS

| | | | | |
|---|---|---|---|---|
| 6,133,847 | A * | 10/2000 | Yang | 340/12.25 |
| 6,735,287 | B2 | 5/2004 | Vishik et al. | |
| 6,844,900 | B2 | 1/2005 | Yuen | |
| 6,902,332 | B2 | 6/2005 | McLoone | |
| 6,946,970 | B2 | 9/2005 | Stefanik et al. | |
| 7,065,184 | B2 | 6/2006 | Vishik et al. | |
| 7,259,710 | B2 | 8/2007 | Kisliakov | |
| 7,272,145 | B2 | 9/2007 | Chen et al. | |
| 7,385,548 | B2 | 6/2008 | Stefanik | |
| 7,415,502 | B2 | 8/2008 | Vishik et al. | |
| 7,630,478 | B2 | 12/2009 | Vishik et al. | |
| 7,653,926 | B2 | 1/2010 | Stefanik | |
| 7,685,341 | B2 * | 3/2010 | Steinberg et al. | 710/72 |
| 7,746,884 | B2 | 6/2010 | Van Vleck et al. | |
| 7,778,263 | B2 | 8/2010 | Chen et al. | |
| 7,860,962 | B2 | 12/2010 | White et al. | |
| 7,873,102 | B2 | 1/2011 | Van Vleck et al. | |
| 7,949,105 | B2 | 5/2011 | Vishik et al. | |
| 7,949,305 | B2 | 5/2011 | Sullivan et al. | |
| 7,996,503 | B2 | 8/2011 | Van Vleck et al. | |
| 2001/0009038 | A1 * | 7/2001 | Hayes et al. | 725/133 |
| 2001/0011953 | A1 * | 8/2001 | Shintani et al. | 340/825.22 |
| 2002/0084912 | A1 | 7/2002 | Stefanik | |
| 2003/0095641 | A1 | 5/2003 | Vishik et al. | |
| 2003/0097413 | A1 | 5/2003 | Vishik et al. | |
| 2003/0227407 | A1 | 12/2003 | Yuen | |
| 2004/0010602 | A1 | 1/2004 | Van Vleck et al. | |
| 2004/0022247 | A1 | 2/2004 | Chen et al. | |
| 2004/0075642 | A1 | 4/2004 | Kisliakov | |
| 2004/0247089 | A1 | 12/2004 | Vishik et al. | |
| 2006/0084409 | A1 * | 4/2006 | Ghadiali | 455/352 |
| 2006/0203973 | A1 | 9/2006 | Vishik et al. | |

(Continued)

FOREIGN PATENT DOCUMENTS

EP 907156 A2 * 4/1999

*Primary Examiner* — Howard Williams
(74) *Attorney, Agent, or Firm* — Jackson Walker L.L.P.

(57) ABSTRACT

A method and system for programming, using a removable storage, a remote control apparatus providing universal remote control functionality is disclosed. A removable storage module may be introduced into the remote control apparatus. Programming codes for a remote-controlled device controllable by the remote control apparatus may be transferred from the removable storage module. Executable code for configuring the remote control apparatus may also be transferred. The programming codes may be assigned to control elements of the remote control apparatus. The remote control apparatus may be configured to use at least one of the programming codes to remotely control the remote-controlled device.

11 Claims, 6 Drawing Sheets

U.S. PATENT DOCUMENTS

2006/0251094 A1 11/2006 Van Vleck et al.
2007/0025449 A1 2/2007 Van Vleck et al.
2007/0038773 A1 2/2007 White et al.
2008/0019386 A1 1/2008 Chen et al.
2008/0180302 A1 7/2008 Amron
2008/0189736 A1 8/2008 Edwards et al.
2008/0235745 A1 9/2008 Edwards et al.
2008/0250468 A1 10/2008 Sullivan et al.
2008/0261514 A1 10/2008 Pratt et al.
2009/0019542 A1 1/2009 Vishik et al.
2009/0021651 A1 1/2009 Pratt et al.
2009/0025025 A1 1/2009 Van Vleck et al.
2009/0031375 A1 1/2009 Sullivan et al.
2009/0067591 A1 3/2009 Belz et al.
2009/0070696 A1 3/2009 Belz et al.
2009/0119181 A1 5/2009 Pratt et al.
2009/0125971 A1 5/2009 Belz et al.
2009/0132355 A1 5/2009 Begeja et al.
2009/0157473 A1 6/2009 Belz et al.
2009/0158369 A1 6/2009 Van Vleck et al.
2009/0158373 A1 6/2009 Belz et al.
2009/0172767 A1* 7/2009 Li et al. ..... 725/139
2009/0180377 A1 7/2009 Sullivan et al.
2009/0187955 A1 7/2009 Sullivan et al.
2009/0245494 A1 10/2009 Sullivan et al.
2009/0288115 A1 11/2009 Belz et al.
2009/0312059 A1 12/2009 Pratt et al.
2009/0319607 A1 12/2009 Belz et al.
2010/0015999 A1 1/2010 Belz et al.
2010/0028010 A1* 2/2010 Zhao et al. ..... 398/106
2010/0039214 A1 2/2010 Pratt et al.
2010/0039392 A1 2/2010 Pratt et al.
2010/0039393 A1 2/2010 Pratt et al.
2010/0041374 A1 2/2010 Vishik et al.
2010/0042827 A1 2/2010 Pratt et al.
2010/0050270 A1 2/2010 Pratt et al.
2010/0057575 A1 3/2010 Begeja et al.
2010/0058381 A1 3/2010 Begeja et al.
2010/0060506 A1 3/2010 Maier
2010/0063863 A1 3/2010 Begeja et al.
2010/0069012 A1 3/2010 Sullivan et al.
2010/0082712 A1 4/2010 Pratt et al.
2010/0088149 A1 4/2010 Sullivan et al.
2010/0104024 A1 4/2010 Sullivan et al.
2010/0113160 A1 5/2010 Belz et al.
2010/0115592 A1 5/2010 Belz et al.
2010/0115607 A1 5/2010 Pratt et al.
2010/0118748 A1 5/2010 Pratt et al.
2010/0119051 A1 5/2010 Belz et al.
2010/0121744 A1 5/2010 Belz et al.
2010/0122285 A1 5/2010 Begeja et al.
2010/0122286 A1 5/2010 Begeja et al.
2010/0122306 A1 5/2010 Pratt et al.
2010/0124905 A1 5/2010 Pratt et al.
2010/0125586 A1 5/2010 Van Vleck et al.
2010/0134338 A1 6/2010 Belz et al.
2010/0138499 A1 6/2010 Belz et al.
2010/0138876 A1 6/2010 Sullivan et al.
2010/0144368 A1 6/2010 Sullivan et al.
2010/0145766 A1 6/2010 Begeja et al.
2010/0149982 A1 6/2010 Pratt et al.
2010/0150327 A1 6/2010 Belz et al.
2010/0153764 A1 6/2010 Pratt et al.
2010/0153995 A1 6/2010 Belz et al.
2010/0158533 A1 6/2010 Belz et al.
2010/0161801 A1 6/2010 Belz et al.
2010/0162331 A1 6/2010 Belz et al.
2010/0174572 A1 7/2010 Joseph et al.
2010/0235872 A1 9/2010 Sullivan et al.
2010/0275237 A1 10/2010 Pratt et al.
2010/0289685 A1 11/2010 Pratt et al.
2010/0289954 A1 11/2010 Sullivan et al.
2010/0302057 A1 12/2010 Pratt et al.
2010/0302058 A1 12/2010 Belz et al.
2011/0003587 A1 1/2011 Belz et al.
2011/0010745 A1 1/2011 Belz et al.
2011/0012710 A1 1/2011 Sullivan et al.
2011/0029887 A1 2/2011 Pearson et al.
2011/0037574 A1 2/2011 Pratt et al.
2011/0037611 A1 2/2011 Van Vleck et al.
2011/0037635 A1 2/2011 Van Vleck et al.
2011/0037637 A1 2/2011 Van Vleck et al.
2011/0047284 A1 2/2011 White et al.
2011/0075727 A1 3/2011 Van Vleck et al.
2011/0090085 A1 4/2011 Belz et al.
2011/0093876 A1 4/2011 Belz et al.
2011/0093908 A1 4/2011 Van Vleck et al.
2011/0095873 A1 4/2011 Pratt et al.
2011/0109444 A1 5/2011 Edwards et al.
2011/0113459 A1 5/2011 Crowe et al.
2011/0114716 A1 5/2011 Pratt
2011/0115664 A1 5/2011 Belz et al.
2011/0131600 A1 6/2011 Howcroft et al.
2011/0131605 A1 6/2011 Pratt et al.
2011/0159861 A1 6/2011 Pratt et al.
2011/0161423 A1 6/2011 Pratt et al.
2011/0185042 A1 7/2011 Wohlert et al.
2011/0289113 A1* 11/2011 Arling et al. ..... 707/769

* cited by examiner

PROGRAMMING A REMOTE CONTROL USING REMOVABLE STORAGE

BACKGROUND

1. Field of the Disclosure

The present disclosure relates to remote control apparatus and, more particularly, to programming a remote control apparatus using removable storage.

2. Description of the Related Art

Remote control apparatus provide convenient operation of equipment from a distance. Many consumer electronic devices are equipped with remote control features. Universal remote control devices may be configured to control different pieces of equipment.

DESCRIPTION OF THE EXEMPLARY EMBODIMENTS

Figure 1:
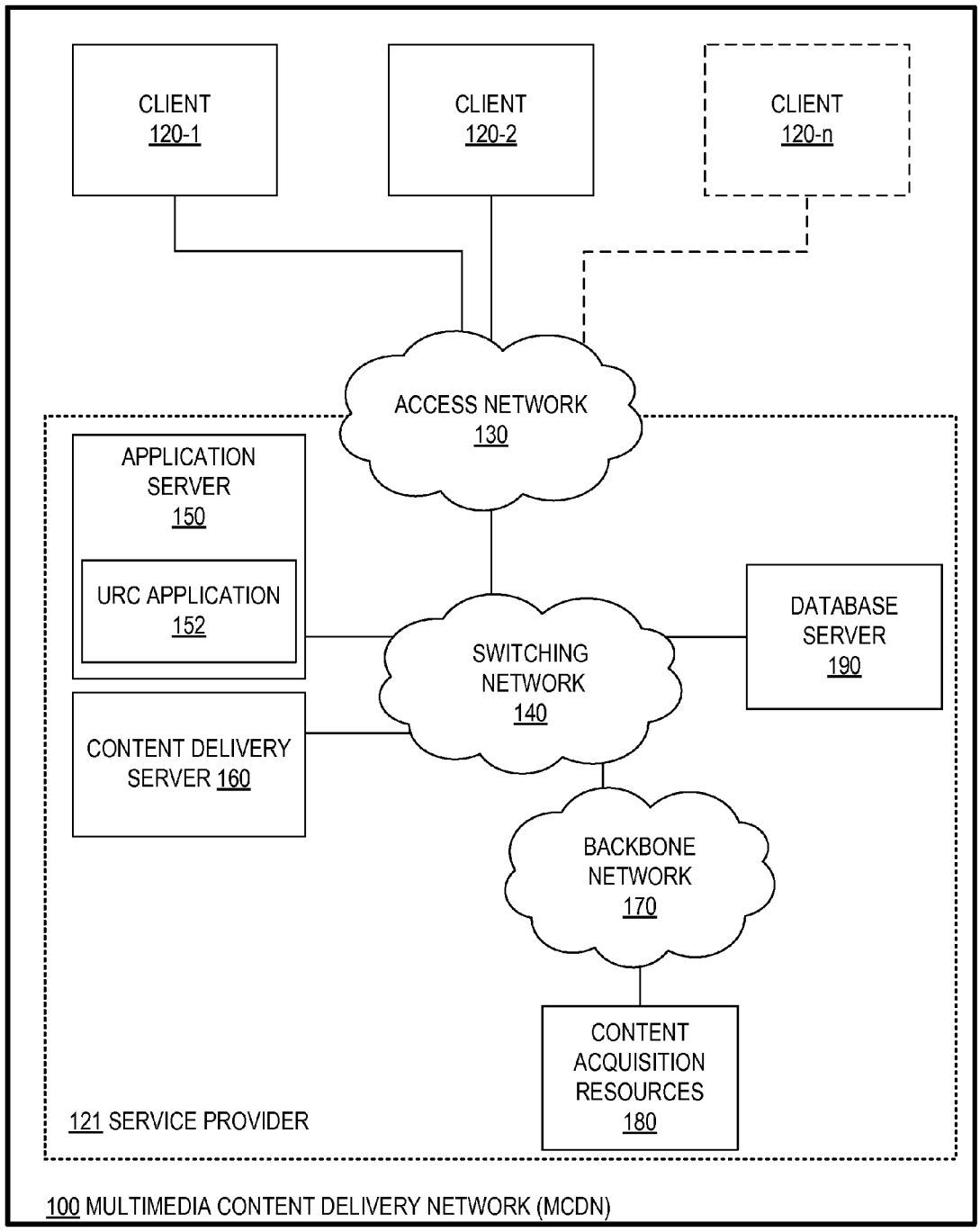
FIG. 1 is a block diagram of selected elements of an embodiment of a multimedia distribution network.

In one aspect, a disclosed method for configuring a universal remote control (URC) includes detecting a removable storage module being coupled to the URC, the storage module including programming codes for a remote-controlled device, and configuring the URC to control the remote-controlled device using the programming codes. The storage module may be a semiconductor memory module. The storage module may include a programmable memory module. The URC may be configured to transfer at least some of the programming codes to a URC memory immovably integrated into the URC.

In some embodiments, the storage module may include configuration code executable by the URC, while the method operation of configuring may further include executing the configuration code. The method operation of configuring may further include assigning the programming codes to control elements of the URC, while a subsequent activation of a control element may invoke a programming code assigned to the control element. Responsive to receiving user input to control the remote-controlled device, the method may further include sending commands to the remote-controlled device, the commands corresponding to the programming codes.

In another aspect, a disclosed remote control apparatus may include a processor, a physical interface for receiving a plurality of removable storage modules, and memory media accessible to the processor. The instructions may be executable by the processor to, in response to detecting a new storage module coupled to the physical interface, receive first information from the storage module identifying a new remote-controlled device. The instructions may further be executable by the processor to identify second information including programming codes for the new remote-controlled device, and transmit at least one of the programming codes to the new remote-controlled device. The memory media may further include processor instructions executable to receive executable code from the new storage module.

In particular embodiments, when the new storage module is detected, the remote control apparatus may include a second storage module coupled to the physical interface, the second storage module including programming codes for a second remote-controlled device that the remote control apparatus may be configured to control. The processor instructions executable to program the remote control apparatus may include processor instructions executable to access the programming codes on the new storage device. The processor instructions executable to program the remote control apparatus may further include processor instructions executable to receive the programming codes in the memory media.

In certain embodiments, the remote control apparatus may be a URC, and further include a control element for receiving user input, while the memory media may include processor instructions executable to assign a programming code for the remote-controlled device to the control element. The memory media may include processor instructions executable to, responsive to receiving user input at the control element to control the remote-controlled device, send commands to the remote-controlled device, the commands corresponding to the assigned programming code.

In various embodiments, the remote control apparatus may be a customer premises equipment (CPE) of a multimedia content distribution network, and further include a remote control transceiver, while the memory media may include processor instructions executable to, responsive to displaying a virtual remote control context, receive a command via the remote control transceiver, and forward a programming code corresponding to the received command to the remote-controlled device. The remote control apparatus may further include a bus interface coupled to the remote-controlled device, while the processor instructions to forward the programming code may include processor instructions executable to forward the programming code via the bus interface.

In yet another aspect, a disclosed computer-readable memory media includes executable instructions for configuring a URC. The instructions may be executable to, in response to detecting a removable storage module coupled to the URC, identify a remote-controlled device controllable by the URC based on a first indication received from the storage module. The instructions may further be executable to identify programming codes for the new remote-controlled device based on a second indication received from the storage module, and configure the URC to use at least one of the programming codes. The instructions executable to configure the URC may include instructions executable to assign a programming code selected from the identified programming codes to a control element of the URC.

In various embodiments, the memory media may include instructions executable to, responsive to receiving user input at the control element to control the remote-controlled device, send a command to the remote-controlled device, the command corresponding to the assigned programming code. The memory media may further include instructions executable to receive executable code from the storage module.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, for example, widget 12-1 refers to an instance of a widget class, which may be referred to collectively as widgets 12 and any one of which may be referred to generically as a widget 12.

Turning now to the drawings, FIG. 1 is a block diagram illustrating selected elements of an embodiment of multimedia content delivery network (MCDN) 100. Although multimedia content is not limited to TV, video on demand (VOD), or pay-per-view (PPV) programs, the depicted embodiments of MCDN 100 and its capabilities are primarily described herein with reference to these types of multimedia content, which are interchangeably referred to herein as "multimedia content", "multimedia content programs", "multimedia programs" or, simply, "programs."

The elements of MCDN 100 illustrated in FIG. 1 depict network embodiments with functionality for delivering multimedia content to a set of one or more subscribers. It is noted that different embodiments of MCDN 100 may include additional elements or systems (not shown in FIG. 1 for clarity) as desired for additional functionality, such as data processing systems for billing, content management, customer support, operational support, or other business applications.

As depicted in FIG. 1, MCDN 100 includes one or more clients 120 and a service provider 121. Each client 120 may represent a different subscriber of MCDN 100. In FIG. 1, a plurality of n clients 120 is depicted as client 120-1, client 120-2 to client **120-*n*, where n may be a large number. Service provider 121 as depicted in FIG. 1 encompasses resources to acquire, process, and deliver programs to clients 120 via access network 130. Such elements in FIG. 1 of service provider 121 include content acquisition resources 180 connected to switching network 140 via backbone network 170, as well as application server 150, database server 190, and content delivery server 160, also shown connected to switching network 140**.

Access network 130 demarcates clients 120 and service provider 121, and provides at least one connection path between clients 120 and service provider 121. In some embodiments, access network 130 is an Internet protocol (IP) compliant network. In some embodiments, access network 130 is, at least in part, a coaxial cable network. It is noted that in some embodiments of MCDN 100, access network 130 is owned and/or operated by service provider 121. In other embodiments, a third party may own and/or operate at least a portion of access network 130.

In IP-compliant embodiments of access network 130, access network 130 may include a physical layer of unshielded twisted pair cables, fiber optic cables, or a combination thereof. MCDN 100 may include digital subscriber line (DSL) compliant twisted pair connections between clients 120 and a node (not depicted) in access network 130 while fiber, cable or another broadband medium connects service provider resources to the node. In other embodiments, the broadband cable may extend all the way to clients 120.

As depicted in FIG. 1, switching network 140 provides connectivity for service provider 121, and may be housed in a central office or other facility of service provider 121. Switching network 140 may provide firewall and routing functions to demarcate access network 130 from the resources of service provider 121. In embodiments that employ DSL compliant connections, switching network 140 may include elements of a DSL Access Multiplexer (DSLAM) that multiplexes many subscriber DSLs to backbone network 170.

In FIG. 1, backbone network 170 represents a private network including, as an example, a fiber based network to accommodate high data transfer rates. Content acquisition resources 180 as depicted in FIG. 1 encompass the acquisition of various types of content including broadcast content, other "live" content including national content feeds, and VOD content.

Thus, the content provided by service provider 121 encompasses multimedia content that is scheduled in advance for viewing by clients 120 via access network 130. Such multimedia content, also referred to herein as "scheduled programming," may be selected using an electronic programming guide (EPG), such as EPG 316 described below with respect to FIG. 3. Accordingly, a user of MCDN 100 may be able to browse scheduled programming well in advance of the broadcast date and time. Some scheduled programs may be "regularly" scheduled programs, which recur at regular intervals or at the same periodic date and time (i.e., daily, weekly, monthly, etc.). Programs which are broadcast at short notice or interrupt scheduled programs are referred to herein as "unscheduled programming."

Acquired content is provided to content delivery server 160 via backbone network 170 and switching network 140. Content may be delivered from content delivery server 160 to clients 120 via switching network 140 and access network 130. Content may be compressed, encrypted, modulated, demodulated, and otherwise encoded or processed at content acquisition resources 180, content delivery server 160, or both. Although FIG. 1 depicts a single element encompassing acquisition of all content, different types of content may be acquired via different types of acquisition resources. Similarly, although FIG. 1 depicts a single content delivery server 160, different types of content may be delivered by different servers. Moreover, embodiments of MCDN 100 may include content acquisition resources in regional offices that are connected to switching network 140.

Although service provider 121 is depicted in FIG. 1 as having switching network 140 to which content acquisition resources 180, content delivery server 160, and application server 150 are connected, other embodiments may employ different switching networks for each of these functional components and may include additional functional components (not depicted in FIG. 1) including, for example, operational subsystem support (OSS) resources.

FIG. 1 also illustrates application server 150 connected to switching network 140. As suggested by its name, application server 150 may host or otherwise implement one or more applications for MCDN 100. Application server 150 may be any data processing system with associated software that provides applications for clients or users. Application server 150 may provide services including multimedia content services, e.g., EPGs, digital video recording (DVR) services, VOD programs, PPV programs, IPTV portals, digital rights management (DRM) servers, navigation/middleware servers, conditional access systems (CAS), and remote diagnostics, as examples.

Applications provided by application server 150 may be downloaded and hosted on other network resources including, for example, content delivery server 160, switching network 140, and/or on clients 120. Application server 150 is configured with a processor and storage media (not shown in FIG. 1) and is enabled to execute processor instructions, such as those included within a software application. As depicted in FIG. 1, application server 150 may be configured to include URC application 152, which, as will be described in detail below, may be configured to provide URC functionality in conjunction with client 120 of MCDN 100.

Further depicted in FIG. 1 is database server 190, which provides hardware and software resources for data warehousing. Database server 190 may communicate with other elements of the resources of service provider 121, such as application server 150 or content delivery server 160, in order to store and provide access to large volumes of data, information, or multimedia content. In some embodiments, database server 190 includes a data warehousing application, accessible via switching network 140, that can be used to record and access structured data, such as program or channel metadata for clients 120. Database server 190 may also store device information, such as identifiers for client 120, model identifiers for remote control devices, and programming codes for URCs.

Figure 2:
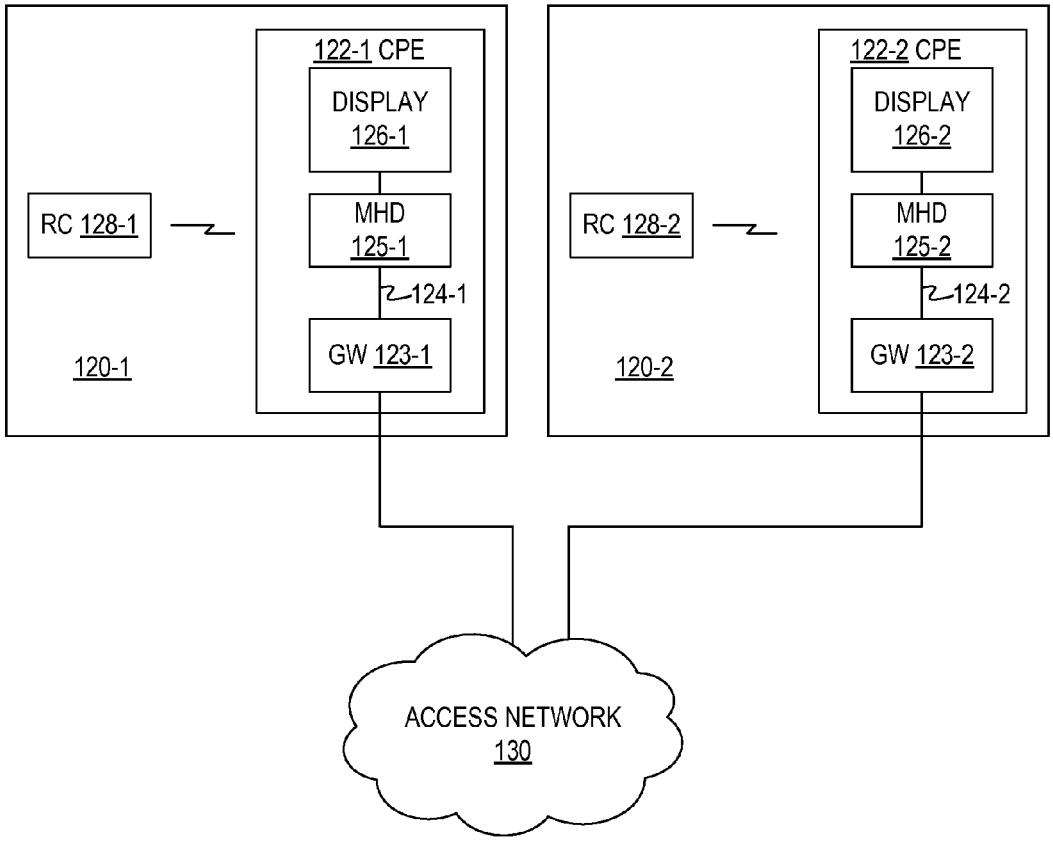
FIG. 2 is a block diagram of selected elements of an embodiment of a multimedia distribution network.

Turning now to FIG. 2, clients 120 are shown in additional detail with respect to access network 130. Clients 120 may include a network appliances collectively referred to herein as CPE 122. In the depicted embodiment, CPE 122 includes the following devices: gateway (GW) 123, multimedia handling device (MHD) 125, and display device 126. Any combination of GW 123, MHD 125, and display device 126 may be integrated into a single physical device. Thus, for example, CPE 122 might include a single physical device that integrates GW 123, MHD 125, and display device 126. As another example, MHD 125 may be integrated into display device 126, while GW 123 is housed within a physically separate device.

In FIG. 2, GW 123 provides connectivity for client 120 to access network 130. GW 123 provides an interface and conversion function between access network 130 and client-side local area network (LAN) 124. GW 123 may include elements of a conventional DSL or cable modem. GW 123, in some embodiments, may further include routing functionality for routing multimedia content, conventional data content, or a combination of both in compliance with IP or another network layer protocol. In some embodiments, LAN 124 may encompass or represent an IEEE 802.3 (Ethernet) LAN, an IEEE 802.11-type (WiFi) LAN, or a combination thereof. GW 123 may still further include WiFi or another type of wireless access point to extend LAN 124 to wireless-capable devices in proximity to GW 123. GW 123 may also provide a firewall (not depicted) between clients 120 and access network 130.

Clients 120 as depicted in FIG. 2 further include a display device or, more simply, a display 126. Display 126 may be implemented as a TV, a liquid crystal display screen, a computer monitor, or the like. Display 126 may comply with a display standard such as National Television System Committee (NTSC), Phase Alternating Line (PAL), or another suitable standard. Display 126 may include one or more integrated speakers to play audio content.

Clients 120 are further shown with their respective remote control 128, which is configured to control the operation of MHD 125 by means of a user interface (not shown in FIG. 2) displayed on display 126. Remote control 128 of client 120 is operable to communicate requests or commands wirelessly to MHD 125 using infrared (IR) or radio frequency (RF) signals. MHDs 125 may also receive requests or commands via buttons (not depicted) located on side panels of MHDs 125.

In some embodiments, remote control 128 may represent a URC device that is configured to control multiple pieces of equipment. When the equipment controlled by the URC device changes, the URC device may be reprogrammed, for example, to add a new device. The URC device may be programmed by various means, such as by using a remote control transceiver (see FIG. 3) coupled to CPE 122. In some cases, a removable storage module (not shown in FIG. 2) may be used to reprogram the URC device, as will be described in detail below.

MHD 125 is enabled and configured to process incoming multimedia signals to produce audio and visual signals suitable for delivery to display 126 and any optional external speakers (not depicted in FIG. 2). Incoming multimedia signals received by MHD 125 may be compressed and/or encrypted, digital or analog, packetized for delivery over packet switched embodiments of access network 130 or modulated for delivery over cable-based access networks. In some embodiments, MHD 125 may be implemented as a stand-alone set top box suitable for use in a coaxial or IP-based MCDN.

Figure 3:
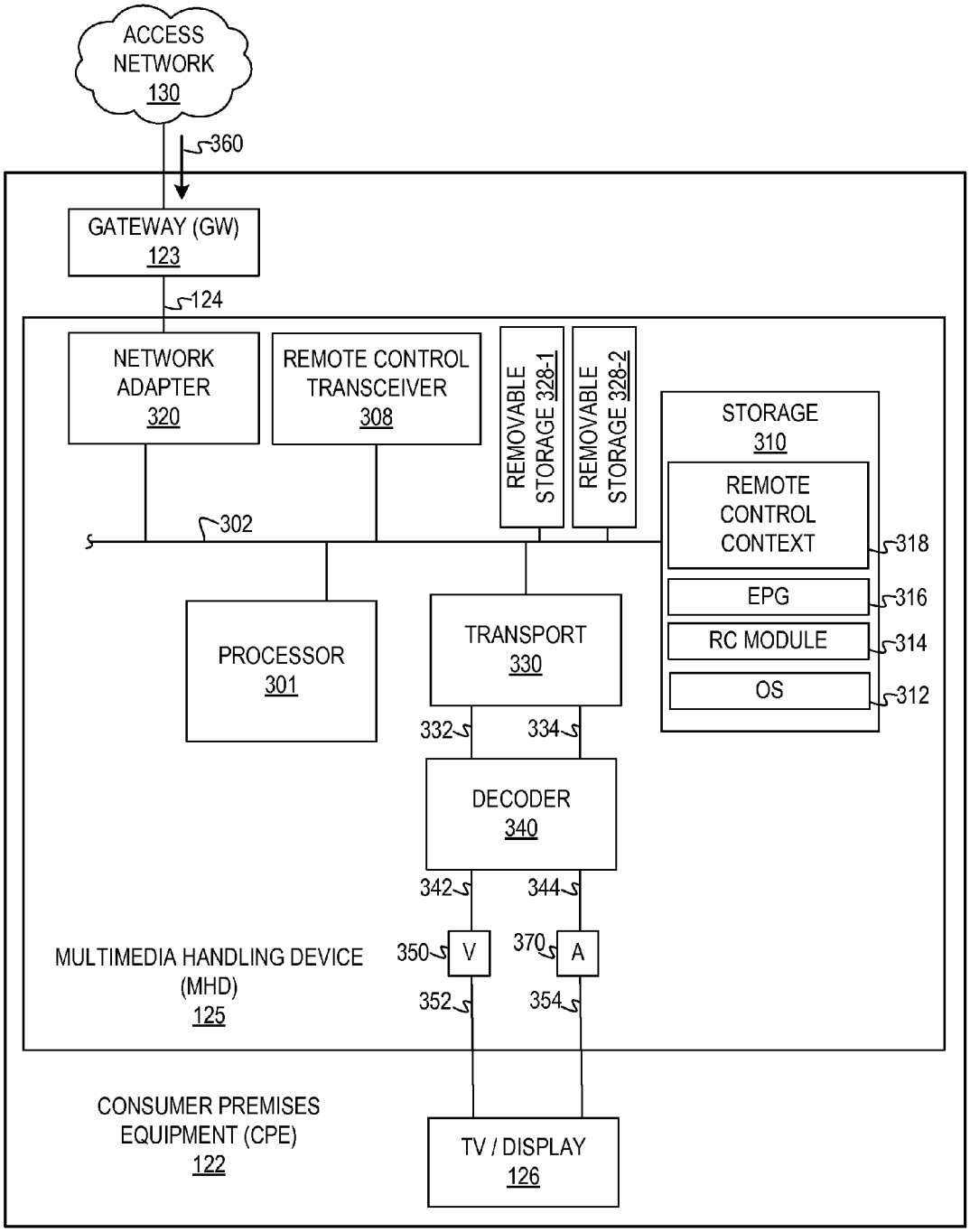
FIG. 3 is a block diagram of selected elements of an embodiment of a multimedia handling device.

Referring now to FIG. 3, a block diagram illustrating selected elements of an embodiment of MHD 125 is presented. In FIG. 3, MHD 125 is shown as a functional component of CPE 122 along with GW 123 and display 126, independent of any physical implementation, as discussed above with respect to FIG. 2. In particular, it is noted that CPE 122 may be any combination of GW 123, MHD 125 and display 126.

In the embodiment depicted in FIG. 3, MHD 125 includes processor 301 coupled via shared bus 302 to storage media collectively identified as storage 310. MHD 125, as depicted in FIG. 3, further includes network adapter 320 that interfaces MHD 125 to LAN 124 and through which MHD 125 receives multimedia content 360. GW 123 is shown providing a bridge between access network 130 and LAN 124, and receiving multimedia content 360 from access network 130.

In embodiments suitable for use in IP-based content delivery networks, MHD 125, as depicted in FIG. 3, may include transport unit 330 that assembles the payloads from a sequence or set of network packets into a stream of multimedia content. In coaxial-based access networks, content may be delivered as a stream that is not packet-based and it may not be necessary in these embodiments to include transport unit 330. In a coaxial implementation, however, clients 120 may require tuning resources (not explicitly depicted in FIG. 3) to "filter" desired content from other content that is delivered over the coaxial medium simultaneously and these tuners may be provided in MHDs 125. The stream of multimedia content received by transport unit 330 may include audio information and video information and transport unit 330 may parse or segregate the two to generate video stream 332 and audio stream 334 as shown.

Video and audio streams 332 and 334, as output from transport unit 330, may include audio or video information that is compressed, encrypted, or both. A decoder unit 340 is shown as receiving video and audio streams 332 and 334 and generating native format video and audio streams 342 and 344. Decoder 340 may employ any of various widely distributed video decoding algorithms including any of the Motion Pictures Expert Group (MPEG) standards, or Windows Media Video (WMV) standards including WMV 9, which has been standardized as Video Codec-1 (VC-1) by the Society of Motion Picture and Television Engineers. Similarly decoder 340 may employ any of various audio decoding algorithms including Dolby® Digital, Digital Theatre System (DTS) Coherent Acoustics, and Windows Media Audio (WMA).

The native format video and audio streams 342 and 344 as shown in FIG. 3 may be processed by encoders/digital-to-analog converters (encoders/DACs) 350 and 370 respectively to produce analog video and audio signals 352 and 354 in a format compliant with display 126, which itself may not be a part of MHD 125. Display 126 may comply with NTSC, PAL or any other suitable television standard.

Storage 310 encompasses persistent and volatile media, fixed and removable media, and magnetic and semiconductor media. Storage 310 is operable to store instructions, data, or both. Storage 310 as shown may include sets or sequences of instructions, namely, an operating system 312, a remote control application program identified as RC module 314, an EPG 316, and remote control context 318. Operating system 312 may be a UNIX or UNIX-like operating system, a Windows® family operating system, or another suitable operating system. In some embodiments, storage 310 is configured to store and execute instructions provided as services to client 120 by application server 150, as mentioned previously.

EPG 316 represents a guide to the multimedia content provided to client 120 via MCDN 100, and may be shown to the user as an element of the user interface. The user interface may include a plurality of menu items arranged according to one or more menu layouts, which enable a user to operate MHD 125. The user may operate the user interface, including EPG 316, using remote control 128 (see FIG. 2) or a URC in conjunction with RC module 314. In some embodiments, URC application 152 (see FIG. 1), in conjunction with remote control context 318, provides functionality to perform URC functions, as will be described in further detail below.

Remote control transceiver 308 represents an interface of MHD 125 for communicating with external devices, such as remote control 128, or another URC device. Remote control transceiver 308 may provide a mechanical interface for coupling to an external device, such as a plug, socket, or other proximal adapter. In some cases, remote control transceiver 308 is a wireless transceiver, configured to send and receive IR or RF or other signals. A URC device configured to operate with CPE 122 may be reconfigured or reprogrammed using remote control transceiver 308. In some embodiments, remote control transceiver 308 is also used to receive commands for controlling equipment from the URC device. Remote control transceiver 308 may be accessed by RC module 314 for providing remote control functionality.

Also depicted in FIG. 3 are removable storage 328-1 and 328-2, representing removable storage modules, which may populate a module interface (i.e., memory slot) that provides coupling to bus 302, through which access to processor 301 and storage 310 is also provided. Although two instances of removable storage 328 are shown in FIG. 3, it is noted that any number of removable storage modules and/or module interfaces may be implemented with MHD 125. Removable storage 328 may be accessible by a user for installation or removal, and may store data, data structures, and executable code. Removable storage 328 may include read/write or programmable portions of storage. Alternatively, removable storage 328 may include read only portions of storage. In certain embodiments, removable storage 328 may be substantially similar to a subscriber identity module (SIM) used to identify a subscriber on a mobile telephony device. In various embodiments, removable storage 328 may be a smart card, a memory module, an integrated circuit card, a semiconductor memory module, or other form of solid-state microelectronic circuitry. Removable storage 328 may include a number of various forms of memory modules, such as, but not limited to, flash memory, EEPROMs, memory cards, flash drives, etc.

Removable storage 328 may accordingly be used as a storage module to transfer programming codes for a remote-controlled device. For example, an instance of removable storage 328 including programming codes may be delivered along with a remote-controlled device. The removable storage 328 may be introduced into a URC device, and, as will be described below, may be used to configure the URC device to remotely control the remote-controlled device.

Figure 4:
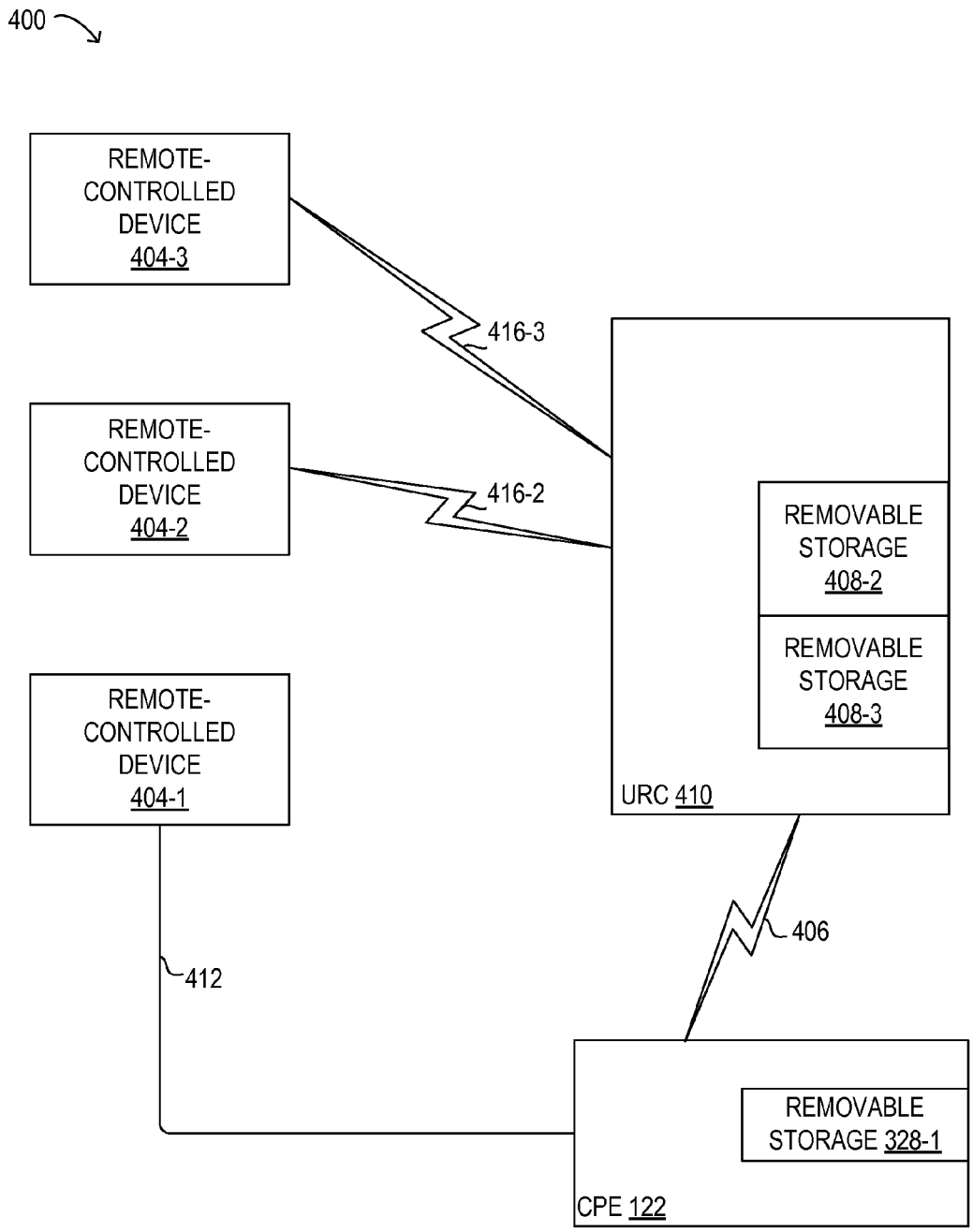
FIG. 4 is a block diagram of selected elements of an embodiment of a universal remote control system.

Turning now to FIG. 4, a block diagram of selected elements of an embodiment of URC system 400 is depicted. In URC system 400, URC 410, and CPE 122 may be in proximity to remote-controlled devices 404-1, 404-2, and 404-3, for example at a location of an MCDN client 120 (see FIG. 1). URC system 400 illustrates devices, interfaces and information that may be processed, in one embodiment, to program URC 410 and/or CPE 122 to control remote-controlled device(s) 404 using removable storage 408. The configuring or programming (as well as the reconfiguring, or reprogramming) of URC 410 may be complex, error prone, or time-consuming for a user. URC system 400 is a platform that may allow a user to easily reprogram URC 410 and/or CPE 122 using removable storage 408. It is noted that in FIG. 4, communication links 406 and 416 may be wireless or mechanically connected interfaces. It is further noted that like numbered elements in FIG. 4 represent components discussed above with respect to FIGS. 1-3.

In FIG. 4, remote-controlled device(s) 404 may refer to a piece of equipment that is introduced for use with or near CPE 122. In some embodiments, remote-controlled device 404 may be controllable by remote control, and may be suitable for control by URC 410. Remote-controlled device 404 may also represent an existing instrument or device that is in use, but not yet controllable using URC 410, because URC 410 may not yet be configured to control remote-controlled device 404. Remote-controlled device 404 may further include one or more local transceivers or interfaces (not explicitly shown in FIG. 4) for communicating with remote controls, or for control by another piece of equipment, as will be described below.

In URC system 400, URC 410 may be configurable to remotely control CPE 122 and/or remotely-controlled device(s) 404. In other words, URC 410 may be configured to remotely control a number of different types of devices (see also FIG. 5). CPE 122 may also be configured to provide URC functionality, for example, by providing a virtual remote control feature via remote control context 318 (see FIG. 3), which may be operable by the user from URC 410. Accordingly, URC 410 and CPE 122 are shown in FIG. 4 with respective removable storage (408 and 328-1).

Removable storage 408 may represent original equipment provided with remote-controlled device(s) 404. Removable storage 408 may provide programming codes, or coded instructions, that are specific to remote-controlled device 404. Removable storage 408 may further be specific to a device-type (i.e., model, configuration, etc.) corresponding to remote-controlled device 404, such that removable storage 408 may be operable with any manufactured instance of a particular device model, represented by remote-controlled device 404.

In some cases remote-controlled device(s) 404 may be coupled to CPE 122, as shown in FIG. 4 by exemplary coupling 412 coupled to remote-controlled device 404-1. The coupling 412 to CPE 122 may be subordinate in nature, such that remote-controlled device 404 may be controlled by CPE 122 in response to commands or signals received by local transceiver 308 (see FIG. 3). In URC system 400, CPE 122 is shown with a single exemplary coupling 412 to remote-controlled device 404-1. It is noted that coupling 412 may be configured to connect CPE 122 to a plurality of remote-controlled device(s) 404 simultaneously. Coupling 412 may thus represent a bus interface coupled to CPE 122 and to a number of remote-controlled devices, over which CPE 122 may forward commands and programming codes to individual remote-controlled devices, such as remote-controlled device 404-1.

In FIG. 4, URC 410 may communicate with CPE 122 via communication link 406. Communication link 406 may be used to receive remote control commands (i.e., in the form of codes or instructions) from URC 410. URC 410 may further communicate with remote-controlled device(s) 404 via communication link 416, which may also be used to send remote control commands. URC 410 may use the same transceiver to implement communication links 406 and 416.

As shown in FIG. 4, URC 410 includes removable storage 408-2 and 408-3, respectively corresponding to remote-controlled devices 404-2 and 404-3, with which URC 410 may communicate via communication links 416-2 and 416-3, respectively. Upon installation in URC 410, removable storage 408-2 may enable URC 410 to become configured to remotely control remote-controlled device 404-2 via communication link 416-2 using corresponding programming codes (not shown in FIG. 4) for remote controlled device 404-2. Upon installation in URC 410, removable storage 408-3 may enable URC 410 to become configured to remotely control remote controlled device 404-3 via communication link 416-3 using corresponding programming codes (not shown in FIG. 4) for remote controlled device 404-3. It is noted that removable storage 408-2 and 408-3 may be independently installed in or removed from URC 410.

In FIG. 4, CPE 122 is shown including removable storage 328-1 (see FIG. 3), corresponding to remote-controlled device 404-1. In certain embodiments, removable storage 408 may be substantially similar to removable storage 328. Upon installation in CPE 122, removable storage 328-1 may enable CPE 122 to become configured to remotely control remote-controlled device 404-1 via coupling 412 using corresponding programming codes (not shown in FIG. 4) for remote-controlled device 404-1. URC 410 may send CPE 122 commands for remote-controlled device 404-1 via communication link 406 in response to CPE 122 providing remote control context 318 (see FIG. 3), which may be specific to remote-controlled device 404-1. In certain embodiments, remote control context 318 may be implemented using executable code received by CPE 122 from removable storage 328-1.

In certain embodiments, CPE 122 may further communicate with MCDN application server 150 via access network 130 (see FIG. 1). Access network 130 may represent a "last-mile" access network providing service to a large number of MCDN client systems (see FIGS. 1-3). Application server 150 may provide URC application 152 to CPE 122 for performing remote control functionality. For example, URC application 152 may host, or provide, a portion of remote control context 318 (see FIG. 3).

In operation of URC system 400, as shown in FIG. 4, a user (not shown) may initiate a URC configuration by introducing removable storage 408 to URC 410 and/or CPE 122. At least one programming code may then be transferred from removable storage 408 to URC 410 and/or CPE 122. Executable code for configuring URC 410 and/or CPE 122 may also be transferred. The user may program (or reprogram) URC control elements (see FIG. 5) to perform operations corresponding to the transferred programming codes. A confirmation may be output by URC 410 and/or CPE 122 indicating successful configuration to control remote-controlled device(s) 404. URC 410 and/or CPE 122 may then control remote-controlled device(s) 404 in response to user input at a URC control element (see FIG. 5).

As shown in FIG. 4, after being successfully configured, URC 410 may directly control remote-controlled devices 404-2 and 404-3 and may use communication link 416 therefor. CPE 122 may be specifically configured to control remote-controlled device 404-1 via coupling 412. Commands for remote-controlled device 404-1 may originate from URC 410, which may communicate with CPE 122 via communication link 406 in conjunction with remote control context 318 (see FIG. 3), even though URC 410 may not be configured with specific programming codes for remote-controlled device 404-1.

Figure 5:
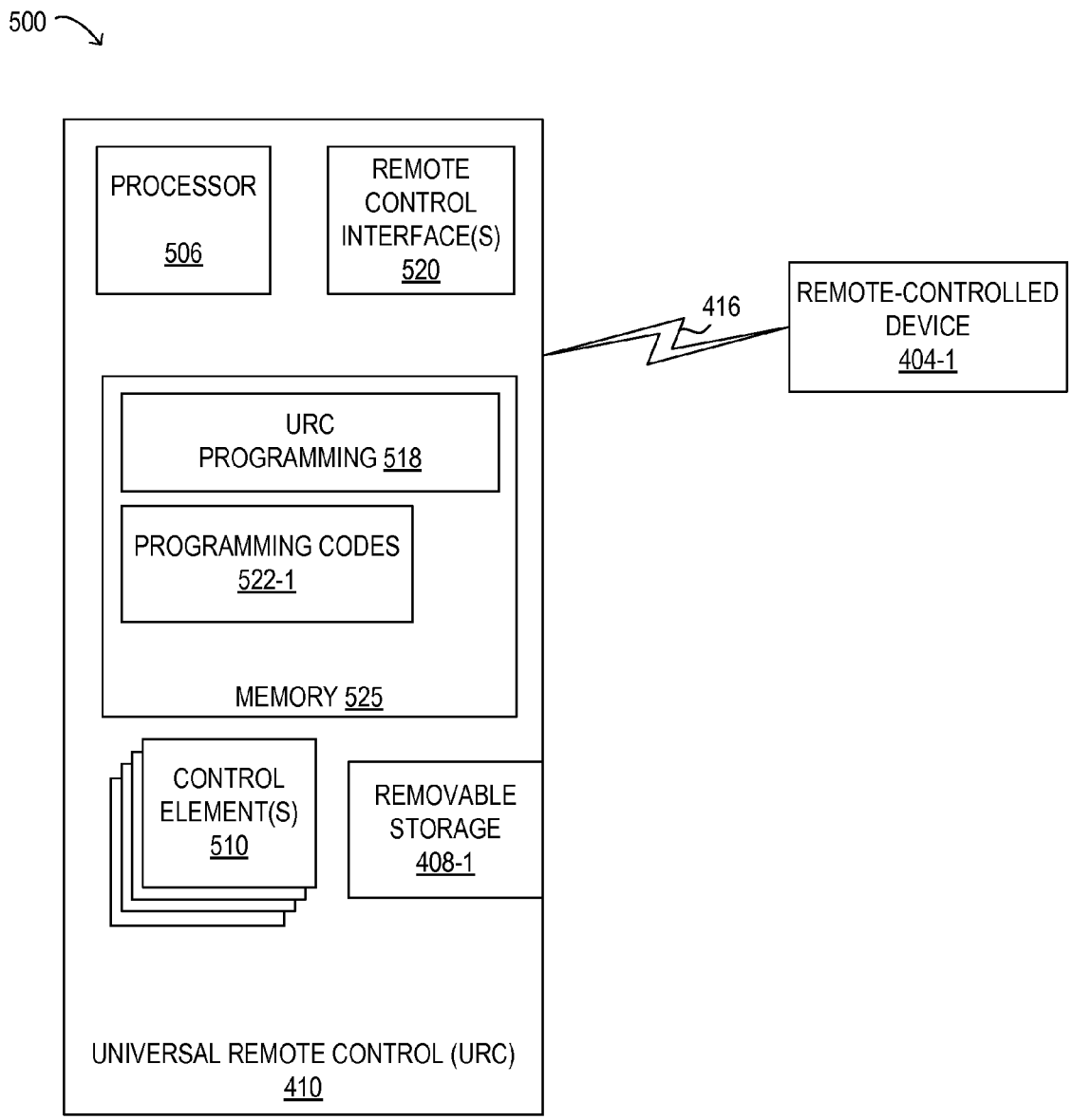
FIG. 5 is a block diagram of selected elements of an embodiment of a universal remote control system.

Turning now to FIG. 5, a block diagram of selected elements of an embodiment of URC system 500 is depicted. In URC system 500, URC 410 may be in proximity to remote-controlled device 404-1, for example at a location of an MCDN client 120 (see FIG. 1). URC system 500 illustrates devices, interfaces and information that may be processed, in one embodiment, to program URC 410 to control remote-controlled device 404-1 using removable storage 408-1. It is further noted that like numbered elements in FIG. 5 represent components discussed above with respect to FIGS. 1-4.

In URC system 500, remote-controlled device 404-1 may represent any of a number of different types of devices that are remote-controlled, such as media players, televisions, and game consoles, among others. URC 410 may send command data, including remote control commands, to remote-controlled device 404-1. Upon receiving command data from URC 410, remote-controlled device 404-1 may execute a remote control function corresponding to the remote control command. In this manner, a user of URC system 500 may be provided a simplified, yet flexible interface for operating remote-controlled device 404-1 using URC 410.

In FIG. 5, URC 410 is depicted communicating with remote-controlled device 404-1 via communication link 416. Communication link 416 may be a wireless or a mechanically connected interface, or some combination thereof.

As shown in FIG. 5, URC 410, which may be a hand-held and manually operated device, includes numerous elements, and may include additional elements (not shown in FIG. 5) in various embodiments. URC 410 is shown further including processor 506, remote control interface(s) 520, memory 525, and control element(s) 510. Memory 525 is depicted in FIG. 5 including URC programming 518 and programming codes 522-1. Accordingly, URC 410 may comprise elements configured to function as an embodiment of an electronic device capable of executing program instructions. URC 410 may further include at least one shared bus (not shown in FIG. 5) for interconnectivity among internal elements, such as those depicted in FIG. 5.

Processor 506 may represent at least one processing unit and may further include internal memory, such as a cache for storing processor executable instructions. In certain embodiments, processor 506 serves as a main controller for URC 410. In various embodiments, processor 506 is operable to access removable storage 408-1, as described herein.

In FIG. 5, remote control interface(s) 520 may represent a communications transceiver providing an interface for any of a number of communication links. In certain embodiments, remote control interface(s) 520 supports wireless communication links, such as IR, RF, and audio, among others. Remote control interface(s) 520 may further support mechanically connected communication links, such as galvanically wired connections, and may accordingly include a physical adapter or receptacle for receiving such connections. In one embodiment, remote control interface(s) 520 transforms an instruction for operating remote-controlled device 404-1 into a signal sent via communication link 416. It is noted that remote control interface(s) 520 may be a bidirectional interface, such that responses, such as commands, information, or acknowledgements, may be received from remote-controlled device 404-1 via communication link 416. In one embodiment, a message may be sent to remote-controlled device 404-1 and an acknowledgement of the message may be received from remote-controlled device 404-1. The message may include command data, as will be described below.

Also in FIG. 5, memory 525 encompasses persistent and volatile media, fixed and removable media, magnetic and semiconductor media, or a combination thereof. Memory 525 is operable to store instructions, data, or both. Memory 525 may represent URC memory immovably integrated into the URC, for example by soldering a semiconductor device to a circuit board of URC 410. Memory 525 as shown includes data, which may be in the form of sets or sequences of instructions, namely, URC programming 518. URC programming 518 may include processor executable instructions to configure URC 410 to control remote-controlled device 404-1, as described herein.

URC 410, as depicted in FIG. 5, includes selection control element(s) 510, representing a variety of input control elements integrated into URC 410. Control element(s) 510 may be buttons, sliders, switches or other types of electromechanical input devices. For example, control element(s) 510 may include power control elements for powering URC 410 on or off. Control element(s) 510 may additionally include control elements that generate remote control commands executable by remote-controlled device 404-1, such as, but not limited to, info, play, pause, guide, purchase, browse, etc. In certain embodiments, control element(s) 510 may include control elements associated with a remote control context (not shown in FIG. 5) executing on remote-controlled device 404-1. The remote control context may be in the form of a displayed menu structure that is responsive to control element(s) 510. In particular, control element(s) 510 may include functionality to select an activated item in the remote control context.

In certain embodiments, URC 410 may further include a display element (not shown in FIG. 5), which may represent a display device implemented as a liquid crystal display screen, a computer monitor, a television, a touch screen device, or the like. The display element may comply with a display standard for the corresponding type of display. Standards for computer monitors include analog standards such as video graphics array (VGA), extended graphics array (XGA), etc., or digital standards such as digital visual interface (DVI) or high-definition multimedia interface (HDMI), among others. A television display may comply with standards such as National Television System Committee (NTSC), Phase Alternating Line (PAL), or another suitable standard.

In operation, URC 410, may detect, at some time, an installation of removable storage 408-1, which may be specific to remote-controlled device 404-1. Remote-controlled device 404-1 may be a new device that URC 410 is not yet configured to control. In one embodiment, URC programming 518 may transfer programming codes 522-1 from removable storage 408-1 to memory 525. URC programming 518 may further assign individual ones of programming codes 522-1 to respective individual ones of control element(s) 510. After the assignment, when a particular one of control element(s) 510 is activated by a user, a respective remote control command, corresponding to a respective one of programming codes 522-1, is sent to remote-controlled device 404-1 via communication link 416. URC programming 518 may further obtain, or identify, executable code from removable storage 408-1 and cause such executable code to be executed by processor 506 for configuring URC 410. In certain embodiments, removable storage 408-1 may remain installed in URC 410, while URC programming 518 may be configured to access programming codes stored in removable storage 408-1. According to various embodiments described herein, URC 410 may be configured to remotely control remote-controlled device 404-1 using removable storage 408-1. Although a single instance of remote-controlled device 404-1 and corresponding removable storage 408-1 is shown in FIG. 5, it will be understood that URC 410 may be configured to control a plurality of remote-controlled devices (not shown in FIG. 5), which may be individually configured or reconfigured by installing or removing a respective removable storage in URC 410.

Figure 6:
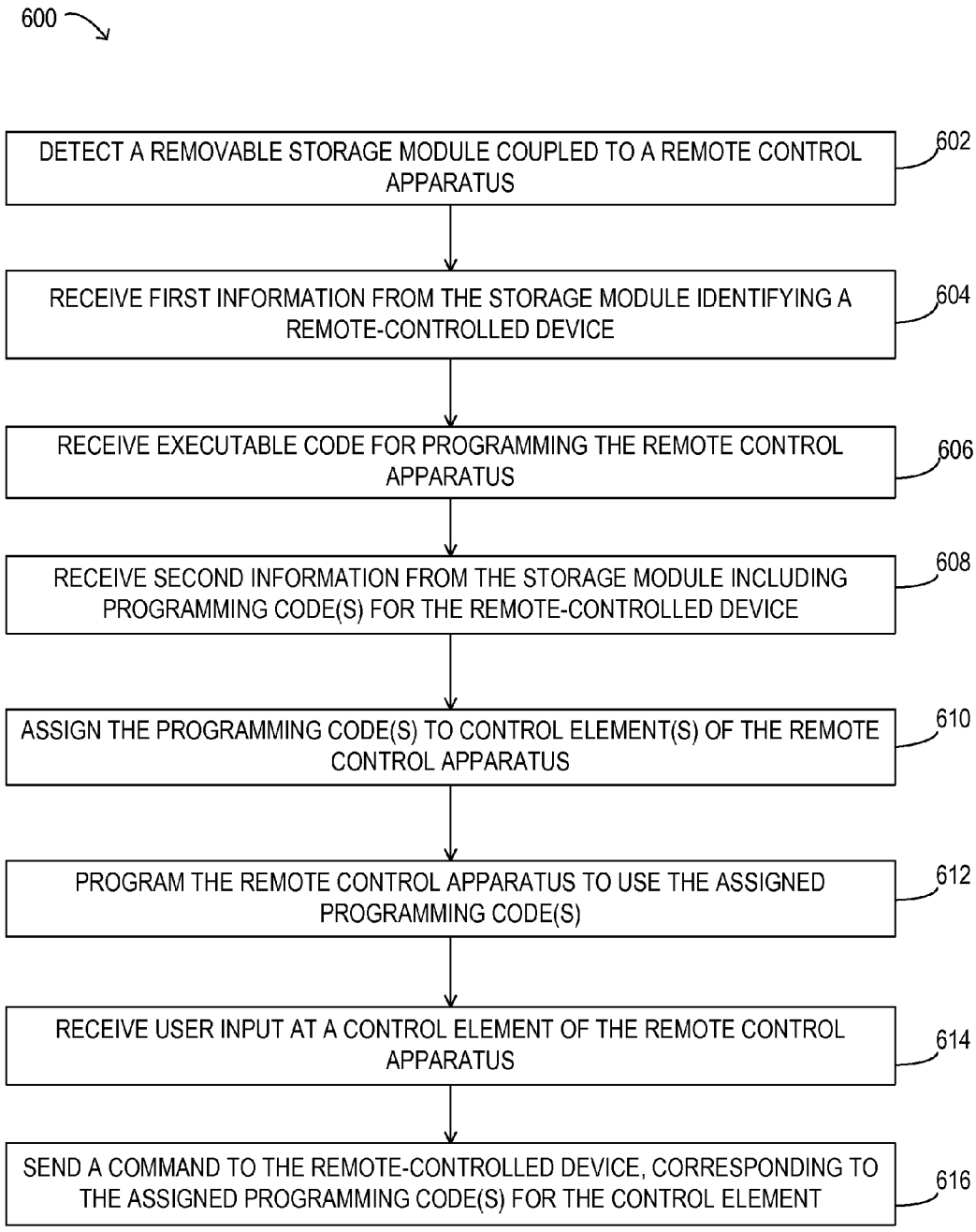
FIG. 6 illustrates an embodiment of a method for programming a universal remote control.

Turning now to FIG. 6, an embodiment of method 600 for configuring a URC is illustrated. In one embodiment, method 600 is performed by URC programming 518 executing on URC 410 (see FIG. 5). In certain embodiments, method 600 may also be executed by RC module 314 and/or remote control context 318 in MHD 125 of CPE 122 (see FIG. 3). In particular embodiments, portions of method 600 may also be performed in conjunction with functionality provided by URC application 152 executing on application server 150 (see FIG. 1). It is noted that certain operations described in method 600 may be optional or may be rearranged in different embodiments. In method 600, it is assumed that remote-controlled device 404 has been newly introduced alongside CPE 122 of MCDN client 120, and that URC 410 is capable of controlling remote-controlled device 404 and/or CPE 122.

Method 600 begins when a removable storage module coupled to a remote control apparatus is detected (operation 602). The remote control apparatus may represent URC 410 and/or CPE 122, in various embodiments. First information identifying a remote-controlled device may be received from the storage module (operation 604). In certain embodiments, the remote control apparatus may use the first information to obtain at least some programming codes from the storage module and/or an external source. An external source may be a database provided by the MCDN. Executable code may be received for programming the remote control apparatus (operation 606). The executable code may be received from the storage module, or from an external source, similar to operation 604. The executable code may be used to implement a portion of method 600. The executable code may be executed by a processor included in URC 410 and/or CPE 122. Second information, including programming code(s) for the remote-controlled device may be received from the storage module (operation 608). In certain embodiments, the storage module may include at least one programming code for a plurality of remote-controlled devices. The specific programming code(s) for the remote-controlled device may be queried from the storage module, based on the first information. Then, the programming code(s) may be assigned to control element(s) of the remote control apparatus (operation 610). The control element(s) may be physical control element(s), or virtual control element(s), such as control element(s) in a remote control context. A control element may be assigned to multiple programming codes, for example, in a predetermined sequence. The remote control apparatus may be programmed to use the assigned programming code(s) (operation 612). The remote control apparatus may provide an indication of being successfully configured and/or programmed to control the remote-controlled device. In certain embodiments, the removable storage module may be removed, while the remote control apparatus remains configured to control the remote-controlled device.

Proceeding with method 600, user input may be received at a control element of the remote control apparatus (operation 614). The user input may cause assigned programming code(s) corresponding to the control element to be identified or retrieved. That is, in response to activation of the control element by user input, a programming code assigned to the control element may be invoked. A command corresponding to the assigned programming code(s) for the control element may be sent to the remote-controlled device (operation 616).

Sending the command may cause the remote-controlled device to execute a function corresponding to the assigned programming code(s) and/or the control element.

To the maximum extent allowed by law, the scope of the present disclosure is to be determined by the broadest permissible interpretation of the following claims and their equivalents, and shall not be restricted or limited to the specific embodiments described in the foregoing detailed description.

What is claimed is:

1. A computer-implemented method for configuring a universal remote control, comprising:

detecting, by a set top box networked to an Internet protocol television network, an external storage module being coupled to the set top box, the storage module including programming codes for a remote-controlled device; and configuring the universal remote control to control the remote-controlled device using the programming codes.

2. The method of claim 1, wherein the storage module includes a semiconductor memory module.

3. The method of claim 2, wherein the semiconductor memory module includes a programmable memory module.

4. The method of claim 1, wherein the universal remote control is configured to transfer a programming code to a universal remote control memory immovably integrated into the universal remote control.

5. The method of claim 1, wherein the storage module further includes configuration code executable by the universal remote control and wherein said configuring includes:

executing the configuration code.

6. The method of claim 1, wherein said configuring includes:

assigning the programming codes to control elements of the universal remote control, wherein subsequent activation of a control element invokes a programming code assigned to the control element.

7. The method of claim 1, further comprising:

responsive to receiving user input to control the remote-controlled device, sending commands to the remote-controlled device, the commands corresponding to the programming codes.

8. Non-transitory computer-readable storage media, including processor executable instructions for configuring a universal remote control that, when executed by a processor, cause the processor to perform operations comprising:

in response to detecting, by a set top box, an external storage module coupled to the set top box, identifying a remote-controlled device controllable by the universal remote control based on a first indication received from the storage module;

identifying programming codes for the new remote-controlled device based on a second indication received from the storage module; and configuring the universal remote control to use at least one of the programming codes;

wherein the set top box is privately networked to an Internet protocol television network server.

9. The non-transitory computer-readable storage media of claim 8, wherein the operations include operations for:

assigning a programming code selected from the identified programming codes to a control element of the universal remote control.

10. The non-transitory computer-readable storage media of claim 9, wherein the operations include operations for:

responsive to receiving user input at the control element to control the remote-controlled device, sending a command to the remote-controlled device, the command corresponding to the assigned programming code.

11. The non-transitory computer-readable storage media of claim 8, wherein the operations include operations for:

receiving executable code from the storage module.

* * * * *